US005380230A

United States Patent [19]

Smith et al.

[11] Patent Number: 5,380,230

[45] Date of Patent: Jan. 10, 1995

[54] METHOD OF MANUFACTURING A SINGLE-ENDED INCANDESCENT LAMP

[75] Inventors: Jerry W. Smith, Irvine; Larry R. Fields, Richmond, both of Ky.

[73] Assignee: Philips Electronics North America Corporation, New York, N.Y.

[21] Appl. No.: 121,652

[22] Filed: Sep. 14, 1993

Related U.S. Application Data

[63] Continuation of Ser. No. 805,226, Dec. 11, 1991, Pat. No. 5,270,609.

[51] Int. Cl.[6] ..... H01J 9/12; H01J 9/02

[52] U.S. Cl. ..... 445/32; 445/48

[58] Field of Search ..... 445/32, 48, 27

[56] References Cited

U.S. PATENT DOCUMENTS 2,067,746 1/1937 Zabel ..... 445/48

2,359,302 10/1944 Curtis ..... 445/32

3,600,053 8/1971 Smith ..... 445/32

FOREIGN PATENT DOCUMENTS 63-313463 12/1988 Japan ..... 445/48

*Primary Examiner*—P. Austin Bradley

*Assistant Examiner*—Jeffrey T. Knapp

*Attorney, Agent, or Firm*—Paul R. Miller

[57] ABSTRACT

An incandescent lamp having a filament with an integral support portion between its ends which bears against the lamp envelope for supporting the filament therein is produced. The integral support portion includes a length of electrically conductive support wire enclosed within the filament, the filament being continuously coiled over the entire length of said support wire. Accordingly to a favorable embodiment, the support wire is a retained length of winding mandrel.

5 Claims, 2 Drawing Sheets

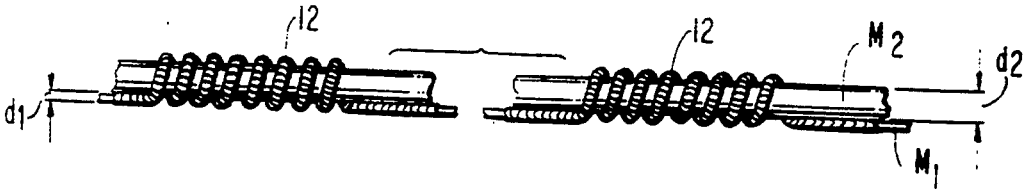
FIG. 2A
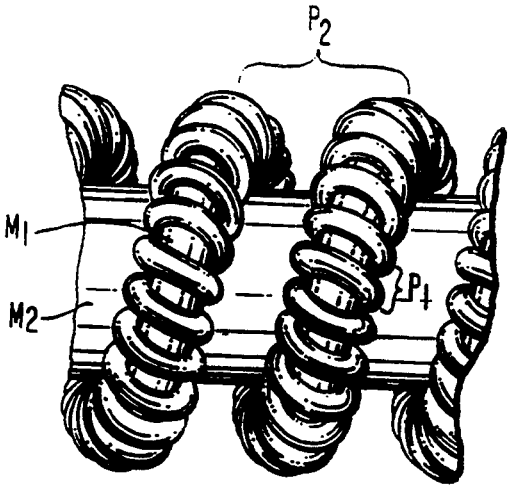
FIG. 2B
FIG. 2C
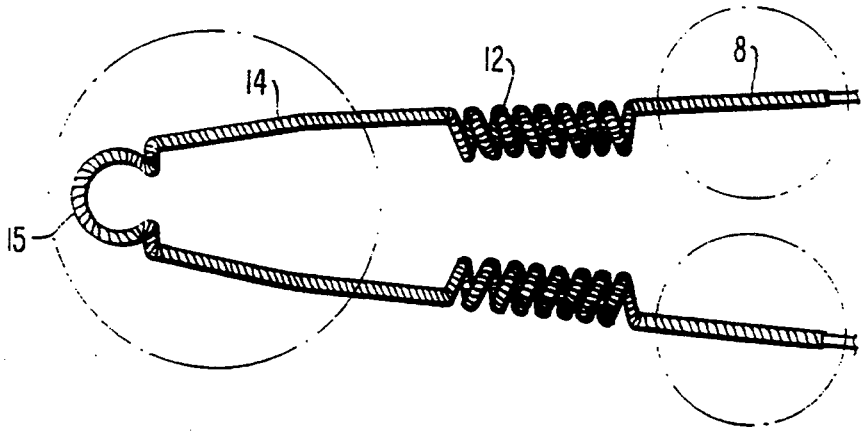

METHOD OF MANUFACTURING A SINGLE-ENDED INCANDESCENT LAMP

This application is a continuation of application Ser. No. 07/805,226, filed Dec. 11, 1991, and now U.S. Pat. No. 5,270,609, issued Dec. 14, 1993, and all benefits of such patent are hereby claimed for this new continuation application.

BACKGROUND OF THE INVENTION

The invention relates to an incandescent electric lamp having a lamp envelope, an incandescent filament arranged within said lamp envelope, current conductors extending through said envelope connected to respective ends of said filament for supplying electric current thereto, and support means between said filament ends for supporting said filament with respect to said lamp envelope.

Such a lamp is known from U.S. Pat. No. 3,600,053, (Smith) which discloses a single ended tungsten halogen cycle lamp having a quartz glass lamp envelope with a pinch seal at one end and a tipped-off exhaust tubulation at the opposite end. The filament is "U" shaped, and is comprised of two symmetrical filament parts. One end of each filament part is connected to a respective current conductor adjacent the pinch seal. The filament is secured to the tubulated end of the envelope by a wire insert secured in the tubulation which has ends that are inserted in the other ends of the two filament parts near the tubulation.

GB 1,178,062 and U.S. Pat. No. 3,544,188 (Danko et al) also disclose lamps having a wire support member fixing the filament to the envelope. These lamps have a support wire with one end secured in the exhaust tubulation and a loop or hook at the other end holding the filament. Additional support for the filament in some lamps is provided by a quartz-glass bridge fixed to the current conductors at a location between the filament ends and the pinch seal. Instead of a support wire fixed in the tubulation, another known lamp construction employs a quartz-glass bridge and a frame wire extending therefrom which supports the filament remote from the pinch seal.

Other types of incandescent lamps also employ wire filament supports which engage the wall of the lamp envelope. Elongate tubular incandescent lamps, such as the photocopier lamp of U.S. Pat. No. 5,001,388, commonly employ a plurality of spiral wire supports which hold the filament and spiral outwards to engage the wall of the envelope and support the filament on the lamp axis.

In the above lamps, the wire filament supports are undesirable because they increase the number of lamp parts, complicate lamp assembly and parts handling, and generally increase the cost of the lamp. The looped or hooked supports are detrimental to lamp life because they sufficiently lower the temperature of the filament to subject the filament to halogen attack at the areas where they contact the filament. The filaments are also susceptible to breakage from physical shock because of the high temperature gradient of the filament next to the support points and the small contact area between the loop or hook of the wire support and the filament. Additionally, in single ended lamps which employ a bridge, the lamp envelope must be long enough to accommodate the bridge, and provide clearance between the bridge and the pinch seal, the coil, and the upper support. Thus, the lamp envelope must be longer than necessary for enclosing the filament.

Accordingly, it is the object of the invention to provide an incandescent lamp of the kind described in the opening paragraph with improved filament support means which overcome the above-mentioned disadvantages.

SUMMARY OF THE INVENTION

The above object is accomplished in an electric lamp of the type mentioned in the opening paragraph in that the filament support means is comprised of an integral support portion of said filament ,which bears against said lamp envelope, said integral support portion including a length of electrically conductive support wire enclosed within said filament, which filament is continuously coiled over the entire length of said support wire.

The support wire has a much lower resistance than the filament wire and effectively shorts the portion of filament coiled thereabout. This portion of the filament remains below the softening temperature of the lamp envelope and therefore may bear against it. Thus, separate hooked supports extending between the wall of the lamp envelope and the filament are eliminated. The elimination of such hooked supports improves lamp life by reducing the corresponding support contact areas on the filament which are susceptible to localized temperature-dependent halogen attack. Resistance to shock is also increased as compared to lamps with hooked or looped supports because the supported area of the filament is substantially increased due to the length of internal support wire, thereby reducing stress in the filament when the lamp is subjected to shock.

According to a favorable embodiment, the support wire of the integral support portion is a retained length of winding mandrel. A common method of winding coiled filaments is to wind the tungsten filament wire on a molybdenum mandrel. For the well known coiled-coil, or CC2V, filament construction, the tungsten wire is wound with a first pitch around a first mandrel of a first diameter, and then the first mandrel with the tungsten wire coiled thereon is coiled around a second mandrel of a second diameter with a second pitch. Typically, the filaments are cut to length and then the mandrels are removed by dissolving in a suitable acid bath. For some lamp applications, it is known to retain a portion of the mandrel. For example, in tubular lamps, it is known to have multiple portions in which the mandrel is maintained so that there are sequential light emitting/non-emitting portions of the filament. Such a lamp is known from Netherlands Patent 7,904,376 published Feb. 27, 1980. This Netherlands Patent discloses that a winding mandrel may be retained within the desired filament portions by locally providing a cumaron resin on the coiled filament portions in which the winding mandrel is to be retained, the uncovered portions being etched away in the acid bath. Thus, use of a retained length of winding mandrel as the support wire utilizes material which would otherwise be dissolved away.

According to another embodiment, the lamp envelope comprises a protrusion to which the integral support portion is fixed. Preferably, the protrusion protrudes externally from the lamp envelope and encloses a cavity, as may be embodied by a tipped-off tubulation. The filament support portion comprises a resilient loop disposed in this cavity and retained by an internal circumferential lip of the tubulation for holding the filament in tension.

According to yet another embodiment, the lamp has a tubular lamp envelope having opposing sealed ends. The filament extends longitudinally within the envelope and has a plurality of said integral support portions. The filament portions between the integral support portions are light emitting. The integral support portions are non-light emitting and bear on the lamp envelope for supporting the light emitting sections away from the lamp envelope.

According to an attractive embodiment of the invention, a single-ended halogen incandescent lamp includes a lamp envelope having a press or pinch seal at one end and a tipped-off tubulation at an opposing end. A tungsten filament comprises a continuous length of coiled wire having respective ends adjacent the pinch seal. An integral support portion between the ends has a length of retained winding mandrel contained within the coiled filament wire. The support section is secured within the tubulation and supports the filament in tension.

These and other aspects of the invention are further described in the following drawings and detailed description of the invention.

BRIEF DESCRIPTION OF THE DRAWINGS

FIG. 2A shows a length of filament during an intermediate manufacturing step;

FIG. 2B shows a portion of the filament in FIG. 2A;

FIG. 2C shows a finished filament for inclusion in the lamp of FIG. 1; and

DESCRIPTION OF THE PREFERRED EMBODIMENTS

Figure 1:
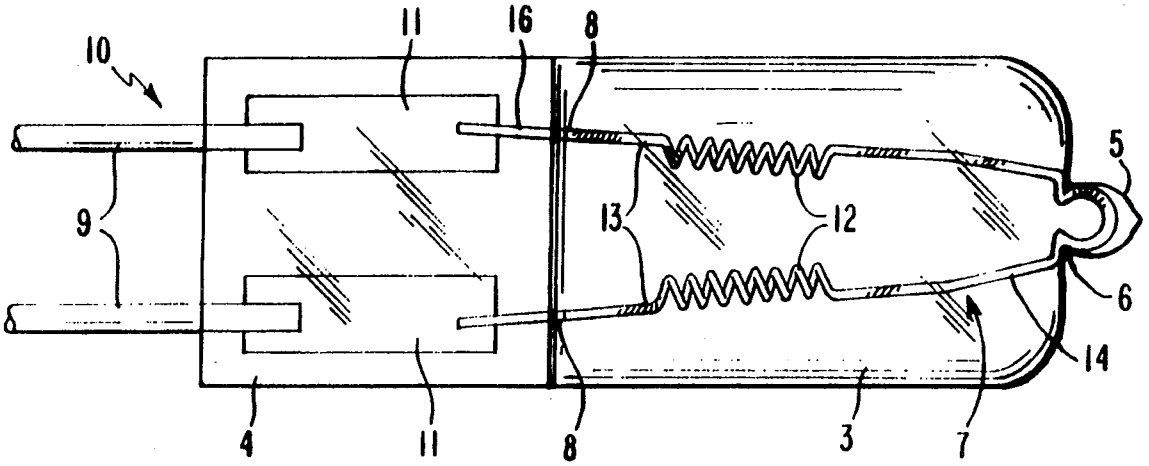
FIG. 1 is a side elevation of a single ended tungsten-halogen incandescent lamp according to the invention.

The tungsten halogen incandescent lamp shown in FIG. 1 has a quartz glass envelope 3 with a pinch seal 4 at one end and a tipped-off tubulation 5 at the other end. The tubulation has an internal circumferential lip 6 where it merges into the wall of the envelope 3. Mounted within the envelope 3 is a tungsten filament 7 having respective ends 8 adjacent press seal 4. Current-conductors 10 which extend through seal 4 are comprised of conventional molybdenum foils 11 welded in a conventional manner to conductive leads 9 and 16. Included within the bulb 3 is a conventional fill gas, including a halogen, such as hydrogen bromide. Application of an electric potential across leads 9 energizes the filament 7 to emit light and to support a tungsten-halogen regenerative cycle.

The filament 7 has two light emitting coiled-coil portions 12, two support legs 13, and a non-light emitting integral support portion 14. The two support legs 13 and the integral support portion 14 are single coiled filament portions which include an electrically conductive support wire therein. The filament is held in tension by loop 15 of the support portion 14 which is retained in the sealed tubulation 5 by the internal circumferential lip 6.

The filament 7 is manufactured by winding a length of tungsten wire with a base pitch $P_1$ on a first mandrel $M_1$, e.g. of molybdenum, having a diameter $d_1$ to achieve a single coiled filament structure. The filament wire while coiled on the first mandrel, is then coiled around a second, e.g. molybdenum, mandrel $M_2$ with a diameter $d_2$ at spaced locations with a second pitch $P_2$ to obtain the coiled-coil filament portions 12 shown in FIG. 2A and 2B. This filament structure, which includes the first and second winding mandrels, is then bent into the desired generally V-shaped form shown in FIG. 2C with loop 15 and ends 8. The integral support portion 14, including loop 15, and the two support legs 13 are then covered in an acid resistant wax, such as cumaron, in the areas identified by the dotted circles of FIG. 2C. The filament is then placed in a conventional acid bath, in a manner well known to those of ordinary skill in the art, to etch away the mandrels which are not covered by the resin wax. After removal from the acid bath, the resin wax is removed from the coated sections 13, 14 and 15 by suitable solvents in a conventional manner. A short length of coiled tungsten wire may then be removed from the filament ends 8 to reveal lengths of the first molybdenum mandrel which function as lead-throughs 16 (FIG. 1). The molybdenum leads 16 can then be welded directly to molybdenum foils 11 in a well known manner.

The filament is inserted into a tubulated envelope and pinch seal 4 is then formed on the foils 11, and leads 9, 16, while the tubulation 5 remains open. After completing seal 4, loop 15 is pulled into the open tubulation by a hooked tool (not shown) inserted through the end of the tubulation into the envelope 3. The loop 15 is of such dimension that it is biased against opposing wall portions of the tubulation and retained by lip 6 to hold the filament with suitable tension from ends 8. After evacuating bulb 3 and filling with an appropriate fill gas and halogen, the tubulation 5 is tipped off in a conventional manner.

The filament shown in FIGS. 2A and 2B is wound with a constant pitch (turns/inch) $P_1$ of 96 turns/cm and a second constant pitch $P_2$ of 15 turns/cm. The first mandrel $M_1$ around which the filament wire is initially wound has a diameter of 0.0178 cm. The second mandrel $M_2$ around which the wound filament is further wound to form coiled-coil portion 12 has a diameter of 0.0838 cm. However, the integral support portion 14 need not have the same pitch $P_1$ as the other filament portions. Additionally, it need not be constant, but may vary over the length of the support wire. For example, near the ends of the support wire, the pitch may be equal to the pitch $P_1$, and vary towards the middle of the support wire to, for example, one-fourth ($\frac{1}{4}$) of the pitch $P_1$. The support portion need not be single-coiled but may be coiled-coil.

Figure 3:
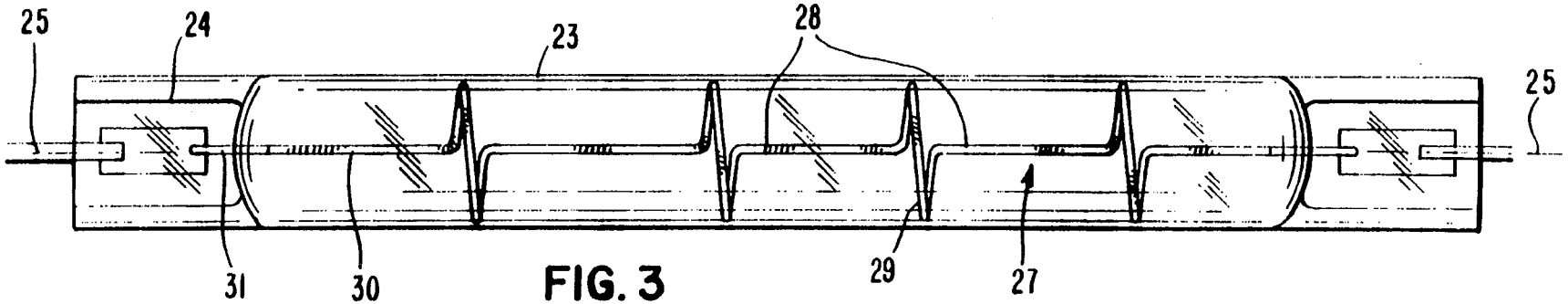
FIG. 3 is a side elevation of a tubular incandescent lamp according to a second embodiment of the invention.

FIG. 3 shows a tubular incandescent lamp having a tubular envelope 23 of quartz glass with opposing pinch seals 24. Single-coiled filament 27 has opposing ends 30 connected to respective current conductors 31 which extend through the pinch seals 24 in a conventional manner. Filament 27 has alternating light-emitting portions 28 and integral support portions 29 which are of single coiled construction and include an internal electrically conductive support wire. The coiled support sections 29 spiral outward from the respective ends of the light-emitting portions 28 and contact the lamp envelope to support the light-emitting portions away from envelope 23 and substantially on the lamp axis 25. The spiral support portions 29 are formed by winding the singled-coiled filament, including its winding mandrel, around a winding die of sufficient diameter for one turn, the portions 28 extending axially along the die for a predetermined distance before forming the next spiral portion 29. The formed filament is then slid off the die and the portions 29 are provided with a cumaron resin. An acid bath then dissolves away the molybdenum mandrel within portions 28, leaving the mandrel/support wire within support portions 29. The resin on portions 29 is then suitably removed.

While there has been shown what are presently considered to be the preferred embodiments of the invention, it will be apparent to those of ordinary skill in the art that various changes and modifications can be made to the filament and lamp without departing from the scope of the invention as defined by the appended claims.

What is claimed is:

1. A method of manufacturing a single-ended incandescent lamp comprising the steps of (a) forming a generally V-shaped filament structure with a resilient loop at the center of a generally V-shaped structure and having respective leads at ends of said generally V-shaped structure, (b) attaching electrical conductors to said leads at said ends, (c) inserting said generally V-shaped filament structure into an envelope having an open first and a tubulated second end, (d) sealing said first end over said leads and said electrical conductors, (e) inserting said resilient loop into said tubulated second end, said resilient loop having a dimension to bias against wall portions of said tubulated second end and to be retained by a lip of said tubulated second end at said envelope, (f) filling said envelope with a fill gas and halogen after evacuation, and (g) closing said tubulated second end over said resilient loop, wherein said generally V-shaped filament structure in step (a) is formed by the steps of (i) winding a length of conductive wire on a first mandrel of a different conductive material at a first pitch to form a single coiled filament structure, (ii) coiling at a second pitch said single coiled filament structure around a second larger mandrel of said different conductive material at a second pitch to form a coiled-coil filament structure at two separated portions of said length, (iii) bending said length between said separated portions to form said generally V-shaped structure, (iv) forming said resilient loop at said center of said generally V-shaped structure, (v) covering said resilient loop and portions of said generally V-shaped structure free of said coiled-coil filament structure with an acid resistant material, (vi) removing said first and second mandrels at areas free of said acid resistant material by etching in an acid bath, and then (vii) removing said acid resistant material to provide said generally V-shape filament structure.

2. A method according to claim 1, wherein said conductive wire is tungsten, and said different conductive material of said first and second mandrels is molybdenum.

3. A method according to claim 1, wherein said acid resistant material is a resin wax.

4. A method according to claim 1, wherein said envelope is of quartz glass.

5. A method according to claim 1, wherein said resilient loop tensions said filament structure against said lip.

* * * * *